US009415602B2

(12) United States Patent
Takeuchi et al.

(10) Patent No.: US 9,415,602 B2
(45) Date of Patent: Aug. 16, 2016

(54) INK JET RECORDING APPARATUS

(71) Applicant: CANON KABUSHIKI KAISHA, Tokyo (JP)

(72) Inventors: Keiichirou Takeuchi, Tokyo (JP); Koichiro Nakazawa, Machida (JP); Fumihiro Goto, Kawasaki (JP); Eisuke Nishitani, Tokyo (JP); Takumi Otani, Kodaira (JP); Kanako Soma, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/095,117

(22) Filed: Dec. 3, 2013

(65) Prior Publication Data

US 2014/0176630 A1 Jun. 26, 2014

(30) Foreign Application Priority Data

Dec. 26, 2012 (JP) ..... 2012-282395

(51) Int. Cl.

| | |
|---|---|
| ***B41J 2/125*** | (2006.01) |
| ***B41J 2/21*** | (2006.01) |
| ***B41J 2/175*** | (2006.01) |
| ***B41J 2/195*** | (2006.01) |

(52) U.S. Cl.

CPC ..... *B41J 2/2142* (2013.01); *B41J 2/17566* (2013.01); *B41J 2/195* (2013.01); *B41J 2/211* (2013.01); *B41J 2/2146* (2013.01)

(58) Field of Classification Search

CPC ..... B41J 2/125; B41J 2/0458; B41J 2/04563; B41J 29/393; B41J 2/04591; B41J 2/04581; B41J 2/2142; B41J 2/2146

See application file for complete search history.

(56) References Cited

U.S. PATENT DOCUMENTS

| | | | | |
|---|---|---|---|---|
| 5,617,122 | A * | 4/1997 | Numata et al. | 347/14 |
| 6,817,692 | B2 * | 11/2004 | Nakazawa et al. | 347/12 |
| 8,320,023 | B2 | 11/2012 | Takahashi et al. | |
| 2002/0012018 | A1 * | 1/2002 | Ohtsuka et al. | 347/19 |
| 2010/0002266 | A1 * | 1/2010 | Takahashi et al. | 358/3.06 |
| 2011/0307763 | A1 * | 12/2011 | Naka | 714/770 |

FOREIGN PATENT DOCUMENTS

| | | | |
|---|---|---|---|
| JP | 2005-186382 | A | 7/2005 |
| JP | 2010-014986 | A | 1/2010 |

* cited by examiner

*Primary Examiner* — Julian Huffman
*Assistant Examiner* — Jeremy Delozier
(74) *Attorney, Agent, or Firm* — Fitzpatrick, Cella, Harper & Scinto

(57) ABSTRACT

An ink jet recording apparatus including an ink tank for storing an ink, a flow path member communicating with the ink tank and a recording head for ejecting the ink supplied from the ink tank through the flow path member, wherein the apparatus further includes a light detection unit which applies light to at least one of the ink in the ink tank and the ink in the flow path member and detects the intensity of back-scattered light of the applied light, and an image density correction unit which corrects the density of an image to be recorded on the basis of the intensity of the back-scattered light which has been detected by the light detection unit.

13 Claims, 6 Drawing Sheets

INK JET RECORDING APPARATUS

BACKGROUND OF THE INVENTION

1. Field of the Invention

The present invention relates to an ink jet recording apparatus.

2. Description of the Related Art

An ink jet recording apparatus is an apparatus capable of recording a high-definition image on a recording medium by ejecting an ink droplet from an ejection orifice provided in a recording head. An ink jet recording apparatus used in a commercial printing field is required to conduct recording at a high speed. Thus, a full-line type recording head is introduced into the ink jet recording apparatus used for such a purpose. The full-line type recording head is provided with an ejection orifice array corresponding to the overall width of a recording medium by arranging plural recording element substrates in each of which a great number of ejection orifices are formed.

When high-speed recording is conducted, the number of ink droplets ejected from one ejection orifice per unit time increases. Thus, heat generated in the recording element substrate increases, and thermal unevenness between the respective recording element substrates is liable to occur. As a result, sticking of a coloring material due to evaporation of an ink occurs in the vicinity of an ejection orifice heated to a high temperature, and so there is a fear of ejection failure of an ink droplet or unevenness of the amount of the ink droplet. As a countermeasure for solving this problem, there is a method in which an ink is circulated up to the vicinity of an ejection orifice at all times to prevent the sticking of the ink. There is another method in which the temperature of an ink during circulation is kept constant to prevent the amount of an ink droplet from changing.

When the ink is circulated at a constant temperature, there is a possibility that water in the ink may be evaporated from each ejection orifice coming into contact with the air to increase the concentration of the ink during the circulation with time. There is thus a possibility that an image density may change. Therefore, it is necessary to periodically detect the ink concentration and correct the image density if the ink concentration has changed.

Patent Literature 1 (Japanese Patent Application Laid-Open No. 2010-014986) discloses a color image forming apparatus in which the density of an image for density detection, which has been recorded on a recording medium, is detected by a density sensor provided in a recording head to correct the density according to the result of the detection.

Patent Literature 2 (Japanese Patent Application Laid-Open No. 2005-186382) describes a method using, as a unit for detecting the concentration of an ink, a light detection unit which detects the intensity of transmitted light in a flow path through which the ink is circulated. Patent Literature 2 also describes a method of supplying a diluent or an ink of a predetermined concentration to an ink tank as a method for correcting the ink concentration.

According to the apparatus described in Patent Literature 1, it is necessary to periodically record the image for density detection on the recording medium. An image (printed article) that is an object of recording cannot be recorded during the recording of this image for density detection. Therefore, the correction of the image density impedes the efficiency of recording. In addition, when a pigment is used as a coloring material for an ink, the transmitted light detection unit described in Patent Literature 2 cannot be used. The reason for this is that light scattering caused by the pigment occurs to prevent the light from transmitting.

SUMMARY OF THE INVENTION

Thus, it is an object of the present invention to provide an ink jet recording apparatus capable of suppressing the lowering of recording efficiency which attends on density correction of an image.

In order to achieve the above object, the present invention provides an ink jet recording apparatus comprising an ink tank for storing an ink, a flow path member communicating with the ink tank and a recording head for ejecting the ink supplied from the ink tank through the flow path member, wherein the apparatus further comprises a light detection unit which applies light to at least one of the ink in the ink tank and the ink in the flow path member and detects the intensity of back-scattered light of the applied light, and an image density correction unit which corrects the density of an image to be recorded on the basis of the intensity of the back-scattered light which has been detected by the light detection unit.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
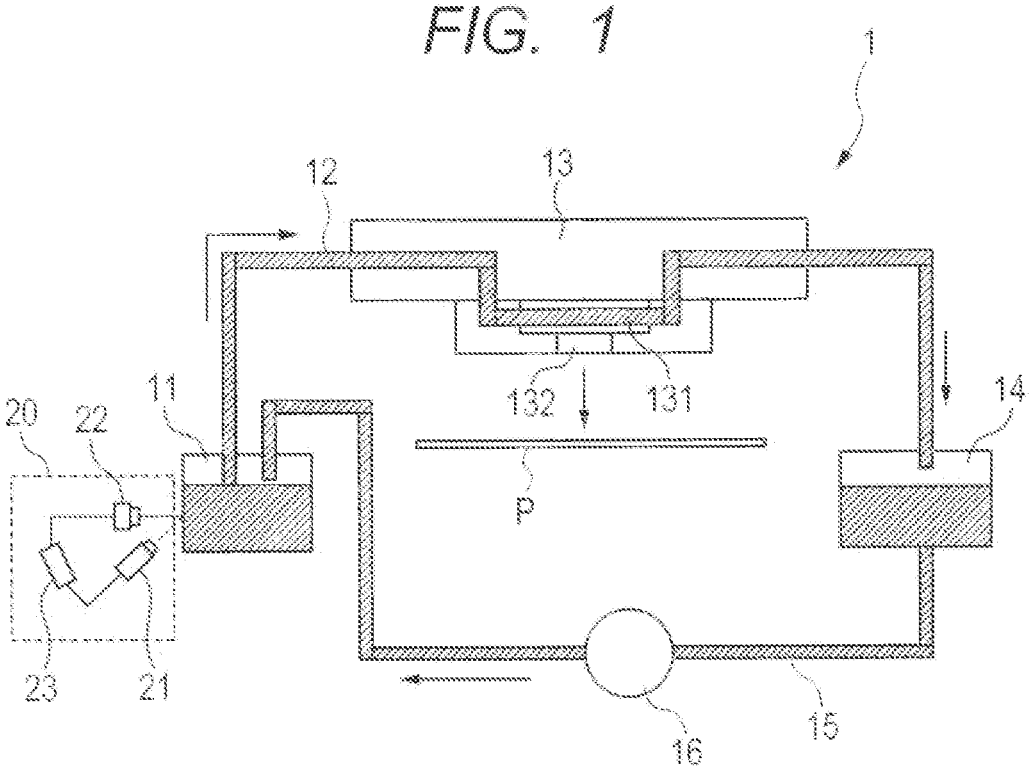
FIG. 1 illustrates an ink jet recording apparatus according to an embodiment of the present invention.

FIG. 1 illustrates an ink jet recording apparatus according to an embodiment of the present invention.

In an ink jet recording apparatus 1 illustrated in FIG. 1, an ink is stored in an ink tank 11. This ink is supplied to a recording head 13 through a flow path member 12 communicating with the ink tank 11.

The ink flowed in the recording head 13 is stored in an ink tank 14 once and then returned to the ink tank 11 through a flow path member 15. The ink is thereby circulated along a circulation path constituted of the ink tank 11, the flow path member 12, the recording head 13, the ink tank 14 and the flow path member 15. A cooling unit 16 is provided in the middle of the flow path member 15 for keeping the temperature of the ink constant. In the ink jet recording apparatus 1, the ink is circulated by a water head difference between the ink tank 11 and the ink tank 14.

In this embodiment, the ink is kept at a fixed temperature and circulated, thereby preventing the ink from sticking in the vicinity of an ejection orifice 132.

The recording head 13 is provided with a heater board 131 on which an electrothermal converter (not illustrated) for generating heat by input of a voltage pulse is mounted. The ink is heated by the heat generated by the electrothermal converter. As a result, an ink droplet is formed. The ink droplet formed is ejected from the ejection orifice 132 formed at a position opposing the electrothermal converter.

In this embodiment, an ink concentration detection device 20 is arranged in the vicinity of the ink tank 11. Incidentally, the above-described ink tank 11, recording head 13 and ink concentration detection device 20 are provided according to the number of ink colors.

The ink concentration detection device 20 has a light detection unit which applies light to the ink in the ink tank 11 and detects the intensity of back-scattered light (hereinafter also referred to as "scattered light" merely) of the applied light and an ink concentration calculation unit which calculates an ink concentration on the basis of the intensity of the back-scattered light detected by the light detection unit. When the ink is, for example, a pigment ink, and the light is applied to the pigment ink, light scattering is caused by pigment particles. The intensity of the scattered light is proportional to the number of the particles. That is, the intensity of the scattered light tends to increase as the ink concentration becomes high. Thus, data that correlates the intensity of scattered light when light is applied with an ink to an ink concentration for every ink color is used, whereby the ink concentration can be detected without recording an image for density detection.

The construction and operation of the ink concentration detection unit 20 will hereinafter be described in detail.

Figure 2:
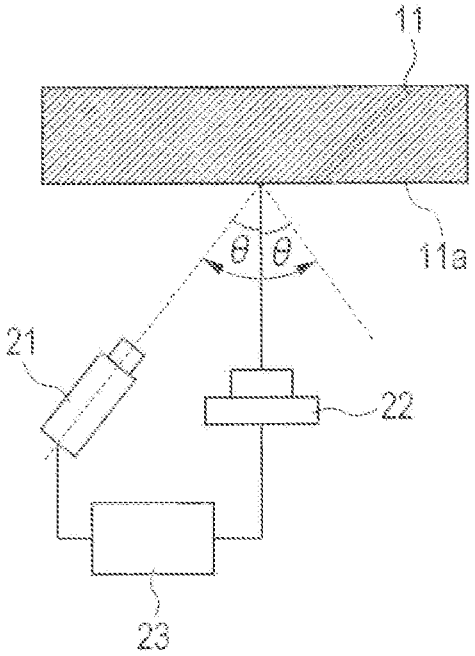
FIG. 2 illustrates the construction of an ink concentration detection device illustrated in FIG. 1.
Figure 3:
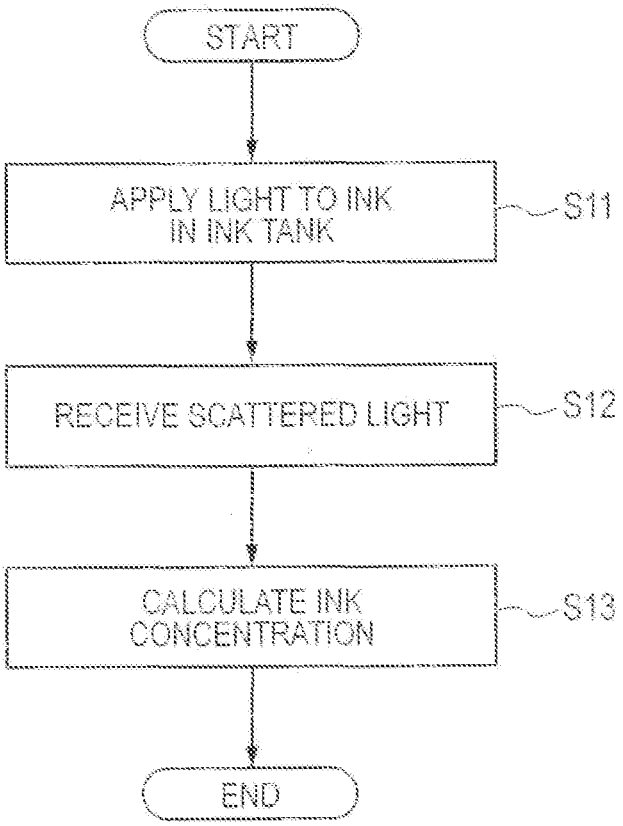
FIG. 3 is a flow chart illustrating the process of an ink concentration calculation operation by the ink concentration detection device illustrated in FIG. 2.

FIG. 2 illustrates the construction of the ink concentration detection device illustrated in FIG. 1. FIG. 3 is a flow chart illustrating the process of an ink concentration calculation operation by the ink concentration detection device illustrated in FIG. 2.

As illustrated in FIG. 2, the ink concentration detection device according to this embodiment has a light application unit 21, a light detection unit 22 and an operation unit 23.

The light application unit 21 applies light to an ink in an ink tank 11 according to a command of an image processing unit 10 (see FIG. 4) which will be described subsequently (Step S11). The applied light is favorably emitted by a semiconductor laser or LED (light emitting diode). However, any other light source may be used. In this embodiment, the light is applied to the ink in the ink tank. However, the light may also be applied to an ink in a flow path member. The light may also be applied to both inks in the ink tank and the flow path member. However, the intensity of back-scattered light can be more stably detected in the case where the light is applied to the ink standing still in the ink tank than the case where the light is applied to the ink flowing in the flow path member. Therefore, the ink concentration detection device 20 is favorably arranged in the vicinity of the ink tank 11 or the ink tank 14.

The light detection unit 22 receives scattered light of the light applied from the light application unit (Step S12). The light detection unit 22 is constituted of a photodiode capable of detecting the intensity of the scattered light. When the light is applied to the ink flowing in the flow path member 12, the flow velocity becomes high as the ink approaches the interior of the flow path member 12, while the flow velocity becomes low in the vicinity of a wall of the flow path member 12. Since light scattering becomes unstable due to the flow velocity of the ink in the interior of the flow path member 12, it is difficult to detect of the intensity of the scattered light. Accordingly, light scattering near the wall with respect to the applied light is received on a back side (applied light side) with respect to the ink tank for the purpose of applying the light to the ink in the flow path member to receive the scattered light with good accuracy. That is to say, it is necessary to receive back-scattered light. When a pigment is used as a coloring material of the ink as described above, light scattering caused by the pigment occurs to prevent the light from transmitting, so that light detection using transmitted light cannot be conducted. However, detection becomes feasible so far as the light to be detected is back-scattered light.

In the present invention, "back-scattered light" means light scattered in a direction of the light application unit with respect to the incident plane 11*a* in FIG. 2 (on a light application unit side of the incident plane 11*a* in FIG. 2). That is to say, the back-scattered light in the present invention also includes reflected light. In the present invention, the whole back-scattered light may not be received, and it is only necessary to receive a part of the back-scattered light so far as the intensity thereof can be sufficiently detected.

When the incident angle of the applied light from the light application unit 21 (angle formed by a line perpendicular to the incident plane 11*a* and an optical axis) is regarded as θ (degrees) as illustrated in FIG. 2, the receiving range (angle) of the light detection unit 22 is favorably more than 0 degree and less than 2θ (degrees) toward the line perpendicular to the incident plane 11*a* for receiving the back-scattered light with good sensitivity. If the receiving range is 2θ (degrees) or more, total reflection light whose intensity is the highest is received, and so detection sensitivity may be deteriorated in some cases. In order to improve measurement accuracy, the position of the light detection unit 22 is favorably a position at which the angle with respect to the incident plane 11*a* is 90 degrees (see FIG. 2).

When the wavelength range of the applied light from the light application unit 21 is a range extended by ±50 nm with respect to a wavelength range of an absorption peak of ink, scattered light corresponding to the ink concentration can be received with higher accuracy because intensity change of the scattered light corresponding to change in the ink concentration becomes most marked in the absorption peak range. In the case of, for example, a cyan ink, the wavelength range of the absorption peak is from 600 nm to 650 nm. Therefore, when an acceptable wavelength range of the applied light from the light application unit 21 is limited to 500 nm or more and 700 nm or less, the light detection unit 22 can detect the intensity of the scattered light corresponding to the ink concentration with high accuracy.

The light detection unit 22 converts the intensity of the detected light to an electric signal. This electric signal is inputted into the operation unit 23. The operation unit 23 calculates an ink concentration using a detected voltage indicated by the electric signal (Step S13).

Figure 4:
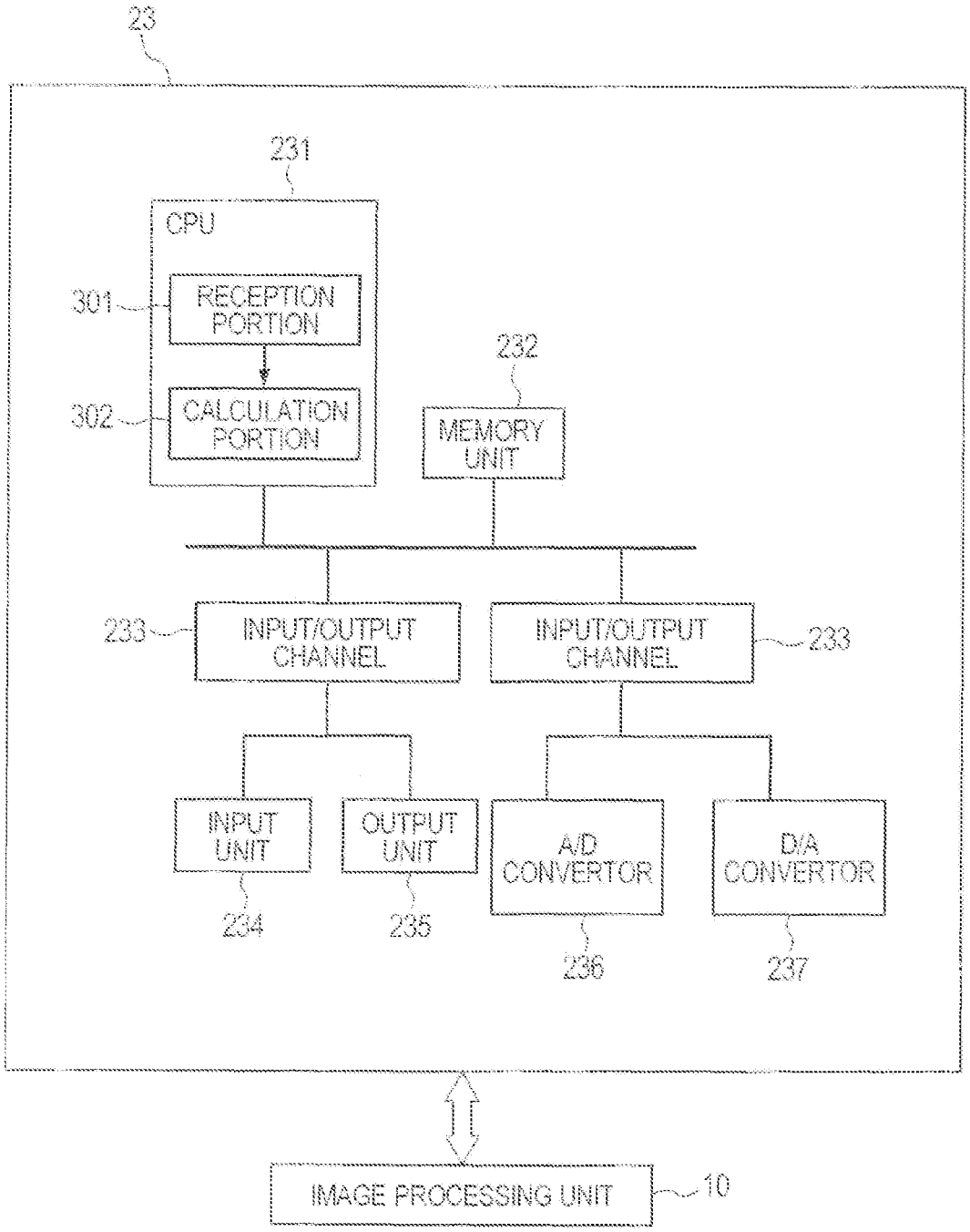
FIG. 4 is a block diagram illustrating the construction of an operation unit 23 illustrated in FIG. 2.

FIG. 4 is a block diagram illustrating the construction of the operation unit 23 illustrated in FIG. 2.

The operation unit 23 is a computer provided with a memory unit 232, an input/output channel 233, an input unit 234 and an output unit 235 in addition to a CPU (central processing unit) 231. An analog-digital conversion circuit composed of an A/D converter 236, a D/A converter 237 and an amplifier (not illustrated) is connected to the input/output channel 233. The CPU 231 operates according to a predetermined program stored in the memory unit 232.

Figure 5:
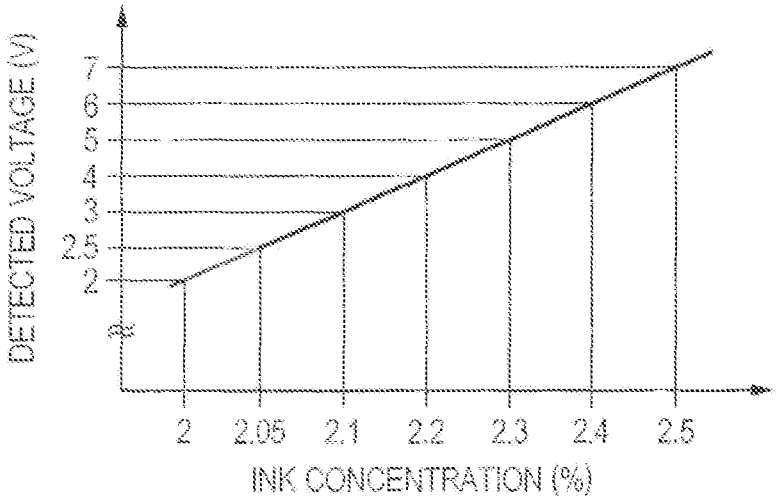
FIG. 5 is a graph illustrating the relation between a detected voltage (intensity of scattered light) indicated by an electric signal from a light detection unit 22 and an ink concentration.

The CPU 231 has a reception portion 301 which receives the electric signal from the light detection unit 22 and a calculation portion 302 which calculates an ink concentration on the basis of the electric signal inputted through the reception portion 301. The detected voltage (intensity of the scattered light) and the ink concentration correspond to each other as illustrated in FIG. 5. Therefore, the calculation portion 302 calculates an ink concentration on the basis of concentration data correlating them with each other. That is, the calculation portion 302 converts the intensity of the scattered light to an ink concentration using this concentration data. This concentration data is prepared in advance and stored in the memory unit 232.

The operation unit 23 sends the calculated ink concentration to an image processing unit 10 (see FIG. 4) provided in an apparatus body. The image processing unit corrects an image density using the data from the calculation portion 23. At that time, the density of an image to be recorded may be corrected on the basis of the intensity of the back-scattered light detected by the light detection unit without providing the ink concentration calculation unit.

When the transmission rate of the applied light from the light application unit 21 is low in the ink tank 11 or 14 or the flow path member 12, there is a possibility that the applied light may not reach the ink, and so the light detection unit 22 may not receive the scattered light. Therefore, a material used in a portion to which light is applied in the ink tank 11 or 14 or the flow path member 12 favorably has such a property that the transmission rate of light applied from the light application unit 21 is 90% or more.

In addition, there is a possibility that the ink during circulation may produce a bubble in the flow path member 12 because the ink has a portion communicating with the air, such as the ejection orifice 132. When this bubble is present at a light applying portion of the light application unit 21, the scattered state of the scattered light (angle distribution of scattering intensity) changes, and so it is assumed that the light detection unit 22 cannot receive the back-scattered light corresponding to the ink concentration with good accuracy. Thus, an inner surface to which light is applied and with which the ink comes into contact in the ink tank 11 or 14 or the flow path member 12 is favorably subjected to a hydrophilizing treatment. Since a liquid easily approaches to the inner surface selectively by conducting the hydrophilizing treatment, attachment of the bubble can be prevented. Specifically, a member whose static contact angle is 30 degrees or less is used as the material of the ink tank 11 or 14 or the flow path member 12, or the hydrophilizing treatment is conducted so as to give a static contact angle of 30 degrees or less. When the material of the ink tank 11 or 14 or the flow path member 12 is any one of aluminum, stainless steel, metals and polyimide and polyethylene resins, a method of the hydrophilizing treatment includes a treatment in which oxygen plasma is applied to bond a hydrophilic functional group. Besides, a surface of a member is coated with a surfactant, whereby the static contact angle of the member can be controlled within a range of 30 degrees or less.

In the above-described ink concentration operation, the light application unit 21 applies light with a predetermined cycle, and the operation unit 23 calculates an ink concentration on the basis of the intensity of the scattered light detected in the light detection unit 22 at every time the light is applied. Change in the ink concentration can be more rapidly detected as the cycle becomes shorter.

An image processing operation by the image processing unit 10 will now be described.

Figure 6:
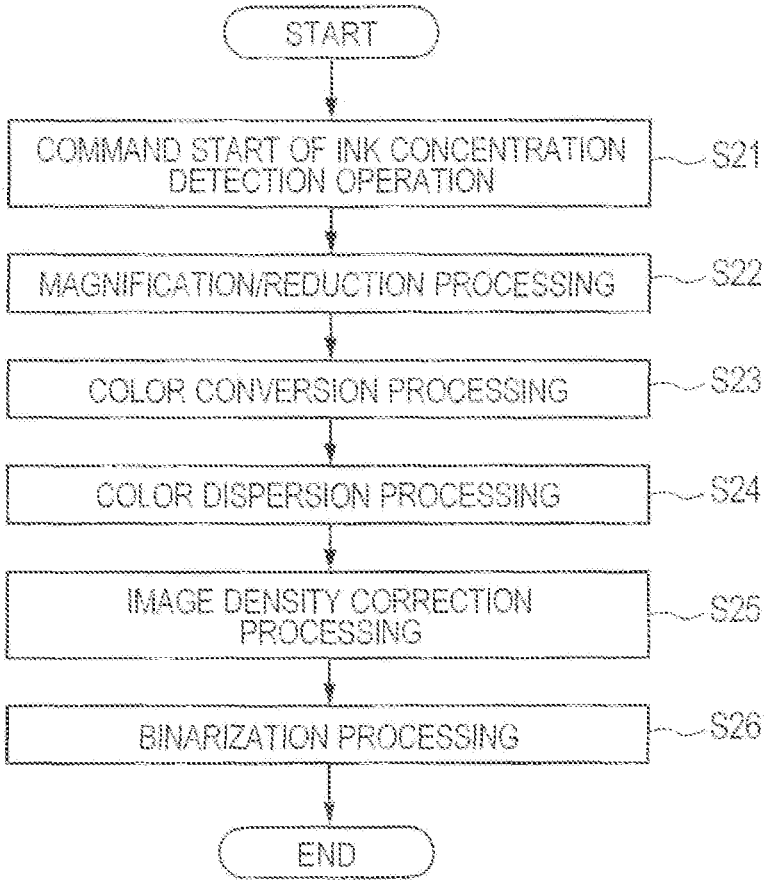
FIG. 6 is a flow chart illustrating the process of image processing performed in the ink jet recording apparatus illustrated in FIG. 1.

FIG. 6 is a flow chart illustrating the process of image processing performed in the ink jet recording apparatus illustrated in FIG. 1.

When image signal data is inputted into the image processing unit 10, the image processing unit 10 commands the ink concentration detection device 20 to start the above-described ink concentration detection operation (Step S21). The image processing unit 10 then executes a magnification/reduction processing of an image (Step S22). When the magnification of the image is designated by a user, or when such a reduction printing that two pages are allocated to one sheet of paper is designated, the image processing unit 10 converts a magnification of the image to its desired magnification. Examples of a converting method includes a bicubic method and a nearest neighbor method.

The image processing unit 10 then executes a color conversion processing in which an image signal date of a standard color space is converted to an image signal date inherent in the recording apparatus (Step S23). This conversion is a conversion called what is called gamut mapping (gamut mapping color conversion). Image signal data obtained by imaging using a digital camera is generally expressed as a value of a standard color space, not RGB (Red Green Blue) expressed in the ink jet recording apparatus of this embodiment. As the standard color space, are known sRGB (standard RGB) prescribed by IEC (Inter Electrotechnical Commission) and Adobe RGB advocated by Adobe Systems Co. In this embodiment, the image processing unit 10 conducts this conversion using a lookup table. Incidentally, a matrix arithmetic method may also be used as a converting method.

The image processing unit 10 then executes a color dispersion processing in which the inherent image signal data is converted to ink color data of cyan (C), magenta (M), yellow (Y) and black (K) (Step S24). This conversion is also executed by means of the same method as the above-described color conversion processing (Step S23).

The image processing unit 10 then executes an image density correction processing on the basis of the ink concentration calculated in the operation unit 23 (Step S25). The contents of the image density correction processing will hereinafter be described in detail.

The image processing unit 10 compares the ink concentration calculated in the operation unit 23 with a predetermined reference value and controls the ink quantity per ink droplet on the basis of the comparison result. Specifically, the image processing unit 10 calculates the ink quantity per ink droplet by means of the following mathematical expression 1. In the following mathematical expression 1, Q1 means an ink quantity per ink droplet corresponding to the reference value (original ink quantity). C1 means a reference value of ink density. C2 means an ink concentration calculated in the operation unit 23. For example, when Q1 is 3 (pl), C1 is 1(%), and C2 is 2(%), that is, the ink concentration increases twofold, the ink quantity Q2 per ink droplet is changed to 1.5 (pl).

Mathematical expression 1:

$$Q2=Q1\times C1/C2.$$

Two methods for controlling the ink quantity per ink droplet will hereinafter be described.

A first method is first described.

As described above, the electrothermal converter (not illustrated) which generates heat by input of a voltage pulse is provided on the heater board 131 of the recording head 13. The quantity of heat generated by the electrothermal converter is controlled by changing the pulse width of this voltage pulse to control the ink quantity per ink droplet.

Figure 7:
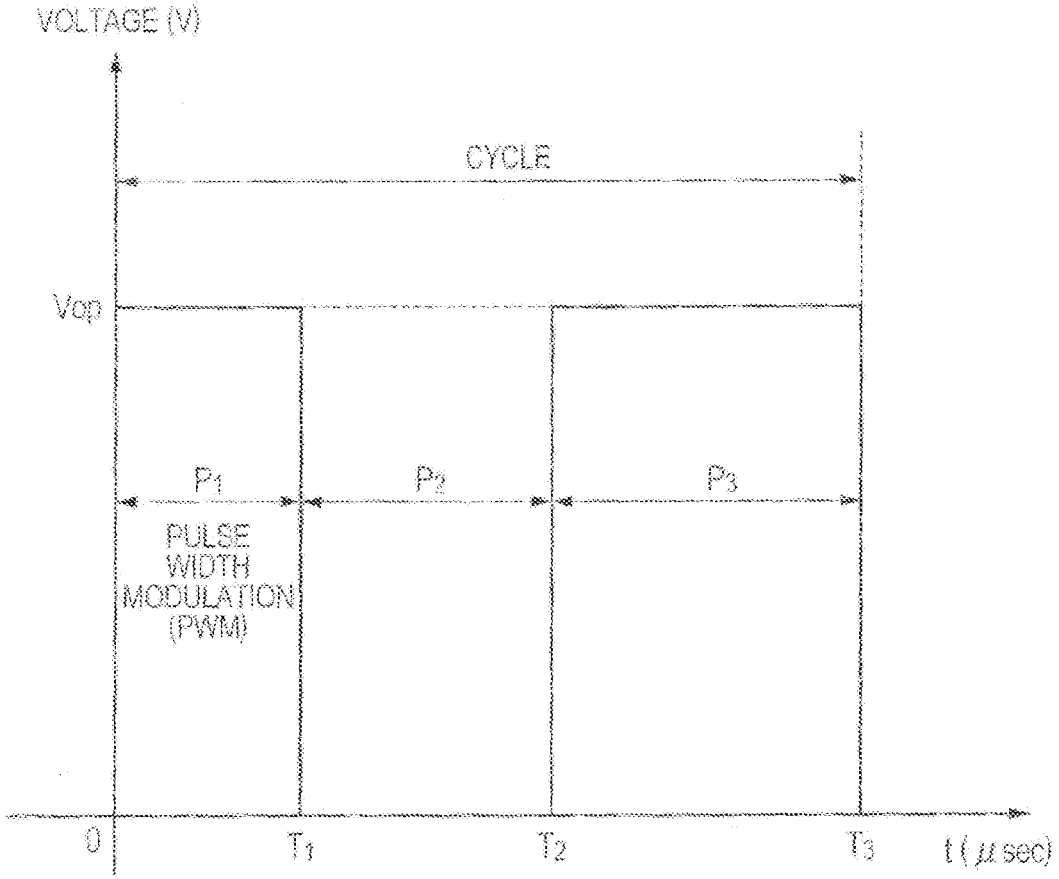
FIG. 7 is a graph illustrating a waveform of a voltage pulse inputted into an electrothermal converter.

FIG. 7 is a graph illustrating a waveform of the voltage pulse inputted into the electrothermal converter. In FIG. 7, Vop means a voltage peak value of the voltage pulse. P1 means a pulse width of a first pulse (hereinafter referred to as a preheat pulse) of plurally divided voltage pulses. P2 means an interval time. P3 means a pulse width of a second pulse (hereinafter referred to as a main heat pulse). T1, T2 and T3 mean times for determining P1, P2 and P3, respectively. The value of the voltage Vop is determined by an area, resistance value and film structure of the electrothermal converter as well as the structure of the recording head 13. In this embodiment, the voltage pulse is inputted into the electrothermal converter in the order of P1 and P3. The preheat pulse is a pulse for mainly controlling the temperature of an ink in the heater board 131. The pulse width of this preheat pulse is set to such a value that a bubbling phenomenon is not caused in the ink by the heat generated by the electrothermal converter.

The interval time is provided for providing a certain time interval so as not to cause mutual interference between the preheat pulse and the main heat pulse and for equalizing the temperature distribution of the ink in the heater board 131. The main heat pulse is a pulse for producing a bubble in the ink to eject an ink droplet from the ejection orifice 132.

The pulse width of the preheat pulse, the interval time and the pulse width of the main heat pulse are respectively changed, whereby the ink quantity per ink droplet can be controlled.

A second method is then described.

When the recording head is a recording head of what is called a thermal system in which an ink is ejected by generating heat by input of a voltage pulse to heat the ink, the ink quantity per ink droplet can be controlled by changing the voltage peak value of the voltage pulse. In the ink jet recording apparatus 1, a bubble is produced by heat generated by the electrothermal converter, and an ink droplet is ejected by the bubble. Therefore, the size of the bubble affects the ink quantity of an ink droplet. The size of the bubble can be changed by the voltage peak value and pulse width of the voltage pulse.

When the voltage peak value is made high and the pulse width is made small, the time required for the heat from the electrothermal converter to reach the ink becomes short to decrease the ink quantity per ink droplet. The reason for this is that the thickness of an ink layer (high-temperature layer) heated at a high temperature and contributing to bubbling becomes thin. Accordingly, when the ink quantity per ink droplet is made small for image density correction, a voltage pulse with a high voltage peak value and a small pulse width is inputted into the electrothermal converter. When the ink quantity per ink droplet is made large to the contrary, a voltage pulse with a low voltage peak value and a long pulse width is inputted into the electrothermal converter.

After the ink quantity per ink droplet is controlled in the above-described manner, the image processing unit 10 executes a binarization processing (Step S26). Thereafter, an ink droplet ejection operation (recording operation) by the recording head 13 is executed.

In the image density correction processing (Step S26), a method of changing the number of ink droplets ejected at a predetermined position may also be employed in place of the method of changing the ink quantity per ink droplet according to the ink concentration. This method will hereinafter be described.

Figure 8:
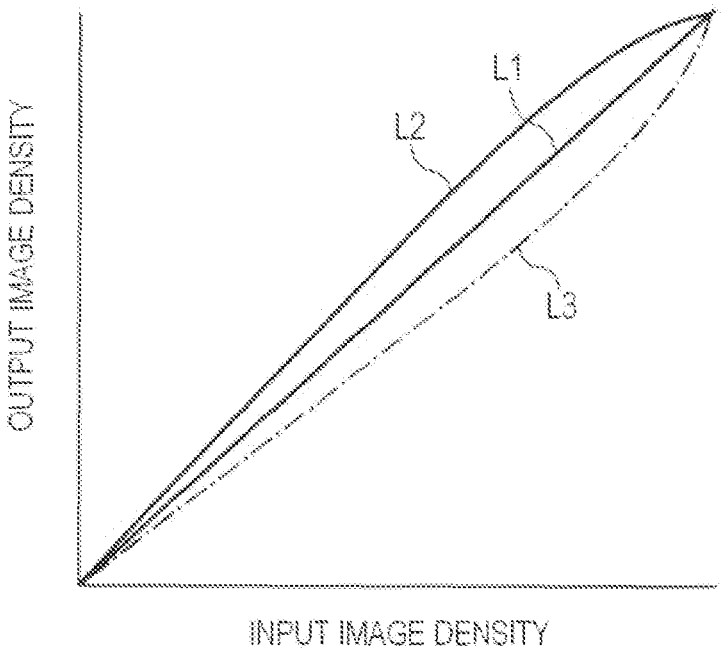
FIG. 8 is a graph illustrating the relation between an input image density and an output image density.

FIG. 8 is a graph illustrating the relationship between an input image density and an output image density. In FIG. 8, the axis of abscissa indicates an input image density which represents the density of image signal date inputted into the image processing unit 10. On the other hand, the axis of ordinate indicates an output image density which represents the density of image date formed by the recording head 13. When the ink concentration is a reference value, the image processing unit 10 converts the input image density to the output image density using a straight line L1 illustrated in FIG. 8. However, when the ink concentration becomes higher than the reference value, the relationship between the input image density and the output image density changes from the straight line L1 to a curved line L2 as illustrated in FIG. 8. And then, the whole output image density becomes higher compared with the straight line L1 before the conversion. Thus, when the ink concentration calculated in the operation unit 23 is higher than the reference value, the image processing unit 10 converts the input image density to the output image density using a curved line L3 illustrated in FIG. 8. Thereafter, the image processing unit 10 sets the number of ink droplets (the number of times of ink droplet ejection per unit time) at a recording position according to the output image density. The recording head 13 ejects ink droplets of the set number. For example, when the ink concentration becomes twice compared with the reference value, the number of ink droplets ejected on a certain position is changed from two droplets to one droplet.

In addition, in the image density correction processing (Step S26), a method of injecting water in the ink tank or flow path member may also be employed in place of the method of changing the ink quantity per ink droplet according to the ink concentration. The method of injecting water will hereinafter be described.

The image processing unit 10 calculates the quantity of water to be injected by means of the following mathematical expression 2. In the following mathematical expression 2, C1 means a reference value of an ink concentration. C2 means an ink concentration calculated in the operation unit 23. V1 means a remaining quantity of the ink in the ink tank 11. Strictly speaking, the ink remains in not only the ink tank 11, but also the flow path member 12. However, the remaining quantity of the ink in the ink tank 11 is very large compared with the remaining quantity in the flow path member 12. Therefore, the remaining quantity of the ink in the ink tank 11 is used in this embodiment. This remaining quantity of the ink can be grasped by arranging the ink tank 11 on a gravimeter.

$$V2=[(C2-C1)\times V1]/C1 \qquad \text{Mathematical expression 2:}$$

Figure 9:
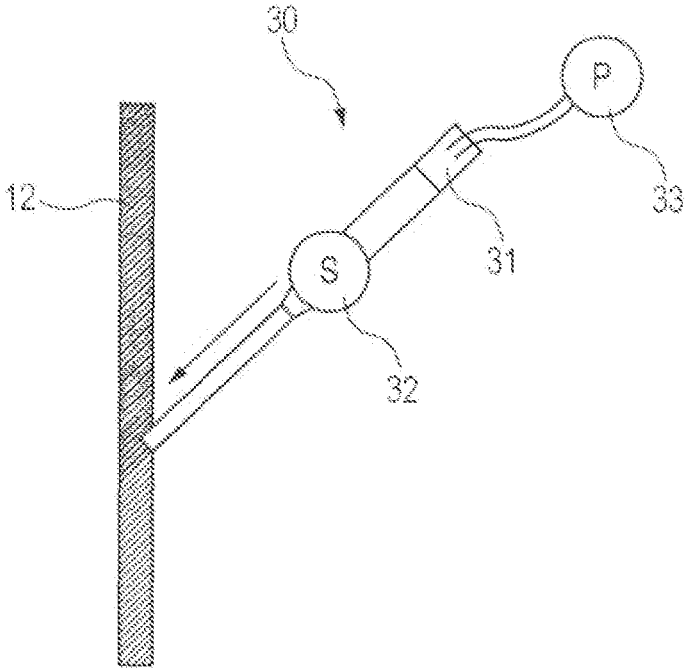
FIG. 9 illustrates the construction of an injection device.

For example, when C1 is 2.0(%), C2 is 2.5(%), and V1 is 1 (kg), the quantity V2 of water to be injected is 0.25 (kg). The image processing unit 10 causes an injection device 30 illustrated in FIG. 9 to inject an injected quantity Q2 of water. The injection device 30 will hereinafter be descried with reference to FIG. 9. FIG. 9 illustrates the construction of the injection device.

In the injection device 30 illustrated in FIG. 9, water is stored in a container 31. This water is injected in the flow path member 12 by an injection controller 32. When the water in the container 31 is used up, water is added from a pump 33.

When the injection controller 32 injects a large quantity of water into the flow path member 12 at a time, water is not smoothly mixed with the ink, and so an operation such as stirring may be required in some cases for stabilizing the concentration. When the ink concentration greatly increases to increase the quantity of water to be injected, the destabilization of the concentration becomes marked in particular. Therefore, the injection controller favorably gradually injects water into the flow path member 12 little by little. Specifically, the quantity of water to be injected per unit time is favorably 1/10 or less of the remaining quantity of the ink in the ink jet recording apparatus 1. For example, when the remaining quantity of the ink in the ink tank 11 is 1 kg and the quantity of water to be injected is 0.25 kg, the injection controller 32 favorably injects water in an amount of 0.1 kg or less per minute into the flow path member 12. It is more favorable that the injection device 30 injects water into the flow path member 12 than into the ink tank 11, because the ink more flows in the flow path member 12 than in the ink tank 11, whereby water relatively quickly diffuses to easily stabilize the ink concentration.

The injection device 30 illustrated in FIG. 9 may be any device so far as it has a function of injecting water stepwise. For example, a syringe pump is applied to the injection device 30.

The kind of an ink usable in the present invention will hereinafter be described. Materials usable in the ink will hereinafter be described.

Examples of a coloring material include pigments and dyes. A pigment is favorably used in the present invention. An inorganic or organic pigment may be used as the pigment. Carbon black is favorably used as the inorganic pigment. A pigment represented by Color Index Number may be used as the organic pigment. The content of the pigment in the ink is desirably 0.5% by mass or more and 15.0% by mass or less, more favorably 1.0% by mass or more and 10.0% by mass or less based on the total mass of the ink.

As a method for dispersing the pigment, any of the conventionally known methods may be used. For example, what is called a self-dispersible pigment in which the surface of a pigment itself is modified so as to be able to disperse without using a dispersant, or a resin-dispersed pigment dispersed with a resin dispersant may also be used. When the resin-dispersed pigment is used, a resin obtained by copolymerizing a hydrophilic monomer and a hydrophobic monomer is favorably used as the resin dispersant. The ratio of the pigment to the resin dispersant is favorably such that the proportion of the resin dispersant is 0.1 or more and 3 or less with respect to 1 of the pigment.

The components of the ink used in the present invention may include various additives such as a surfactant, a pH adjustor, a rust preventive, a preservative, a mildewproofing agent, an antioxidant, an anti-reducing agent, a viscosity modifier and a resin.

When a dye is used as the coloring material in the present invention, a resin particle is favorably contained together. The dye and the resin particle are used in combination, whereby the resin particle scatters light, and so the ink concentration can be calculated on the basis of the concentration of the resin particle even when the back-scattered light is hard to be detected in the case of the dye alone.

EXAMPLES

In the ink concentration detection device 20, applied light from the light application unit 21 is emitted by a semiconductor laser (GH06510F4A, manufactured by SHARP CORPORATION). The light detection unit 22 is constituted of a photodiode (Model Number S5627-01, manufactured by Hamamatsu Photonics K.K.).

The light application unit 21 is arranged at a position where the incident angle θ (see FIG. 2) of the applied light is 45 degrees. The light detection unit 22 is arranged in such a manner that the position to receive the scattered light is 90 degrees with respect to the incident plane 11*a*.

A position to which the applied light is applied in the ink tank 11 is subjected to a hydrophilizing treatment in such a manner that the static contact angle is degrees. The injection device 30 (see FIG. 9) is installed to the flow path member 12. The injection device 30 is a syringe pump 35 Model TE-35 (manufactured by TERUMO CORPORATION).

The ink used is a cyan ink (absorption peak of a coloring material: 600 to 650 nm) whose cyan pigment content is 2% by mass.

In the ink jet recording apparatus 1, the ink was circulated under the environment of the following Pattern 1 or Pattern 2.

Pattern 1

The temperature of the ink in the flow path member 12 is 25° C., and the circulation time is 5 hours.

Pattern 2

The temperature of the ink in the flow path member 12 is 50° C., and the circulation time is 5 hours.

In pattern 1 and Pattern 2, an ink concentration was measured by means of the ink concentration detection device 20 after 5 hours had elapsed from the start of circulation. The results thereof and weight of the ink tank 11 at that time are shown in Table 1.

TABLE 1

| Temperature environment of ink | Pattern 1 | Pattern 2 |
|---|---|---|
| Output voltage value detected | 3 V | 7 V |
| Ink concentration detected | 2.05% | 2.5% |
| Remaining quantity of ink | 0.9 kg | 0.6 kg |

In the environment of each pattern, an image was formed on a recording medium by the recording head 13 under conditions of the following Examples 1 to 5 and Comparative Examples 1 to 3. The nozzle density of the recording head is 1,200 dpi (dot per inch). The recording head 13 ejects one ink droplet on a region of 21.15 μm×21.15 μm (one pixel) that is a minimum unit area of 1,200 dpi within a recording range of 10 cm×10 cm.

Example 1

In Example 1, the ink is circulated under the environment of Pattern 1. In addition, the image processing unit 10 corrects an image density by controlling an ink quantity per ink droplet according to an ink concentration calculated in the operation unit 23.

Example 2

In Example 2, the ink is circulated under the environment of Pattern 1. In addition, the image processing unit 10 corrects an image density by controlling the number of ink droplets according to an ink concentration calculated in the operation unit 23.

Example 3

In Example 3, the ink is circulated under the environment of Pattern 2. In addition, the image processing unit 10 corrects an image density by injecting water from the injection device 30 according to an ink concentration calculated in the operation unit 23. Specifically, since the reference value of the ink concentration is 2.0%, the ink concentration calculated in the operation unit 23 is 2.5%, and the remaining quantity of the ink in the ink tank 11 is 0.6 kg, the quantity of water to be injected is 0.15 kg (see Mathematical expression 2). The injection device 30 injects water at a pace of 0.06 kg per minute into the flow path member 12.

Example 4

In Example 4, the ink is circulated under the environment of Pattern 1. The image processing unit 10 corrects an image density by controlling the number of ink droplets according to an ink concentration calculated in the operation unit 23. However, the applied light from the light application unit 21 is emitted by a semiconductor laser (GH07815D2K, manufactured by SHARP CORPORATION) whose oscillation wavelength is 785 nm.

Example 5

In Example 5, the ink is circulated under the environment of Pattern 2. In addition, the image processing unit 10 corrects an image density by injecting water from the injection device 30 according to an ink concentration calculated in the operation unit 23. The injection device 30 injects water at a pace of 0.07 kg per minute into the flow path member 12.

Comparative Example 1

In Comparative Example 1, the ink is circulated under the environment of Pattern 1, and an image is formed by the recording head 13 without executing the image density correction by the image processing unit 10.

Comparative Example 2

In Comparative Example 2, the ink is circulated under the environment of Pattern 2, and an image is formed by the recording head 13 without executing the image density correction by the image processing unit 10.

In Examples 1 to 5 and Comparative Examples 1 and 2 described above, an image density difference ΔE between an image formed just after starting the circulation of the ink and an image formed after 5 hours was measured. Spectrolino (manufactured by Gretag Macbeth Co.) was used as a measuring instrument. Measured results are shown in Table 2.

TABLE 2

| Ex. 1 | Ex. 2 | Ex. 3 | Ex. 4 | Ex. 5 | Comp. Ex. 1 | Comp. Ex. 2 |
|---|---|---|---|---|---|---|
| A | A | A | B | B | C | C |

In Table 2, "A" indicates that the image density difference ΔE is less than 0.8. "B" indicates that the image density difference ΔE is within a range of 0.8 or more and 2.0 or less. "C" indicates that the image density difference ΔE is more than 2.0.

Comparative Example 3

An experiment was conducted in the same manner as in Example 1 except that the transmitted light detection unit described in Patent Literature 2 was used to attempt the ink concentration detection. However, the ink concentration could not be sufficiently detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-282395, filed Dec. 26, 2012, which is hereby incorporated by reference herein in its entirety.

What is claimed is:

1. An ink jet recording apparatus comprising an ink tank for storing an ink containing a pigment, a flow path member communicating with the ink tank and a recording head for ejecting the ink supplied from the ink tank through the flow path member, wherein the apparatus further comprises a light detection unit which applies light to at least one of the ink in the ink tank and the ink in the flow path member and detects the intensity of back-scattered light of the applied light, and an image density correction unit which corrects the density of an image to be recorded on the basis of the intensity of the back-scattered light which has been detected by the light detection unit, wherein when an incident angle of the applied light is regarded as θ degrees, the back-scattered light is light received in a receiving range of more than 0 degrees and less than 2θ degrees with respect to an incident angle of the applied light.

2. The ink jet recording apparatus according to claim 1, which further comprises an ink concentration calculation unit which calculates an ink concentration on the basis of the intensity of the back-scattered light which has been detected by the light detection unit, wherein the density of the image to be recorded is corrected in the image density correction unit by using the ink concentration calculated in the ink concentration calculation unit.

3. The ink jet recording apparatus according to claim 2, wherein data that correlates the intensity of the back-scattered light with the ink concentration is prepared in advance in the ink concentration calculation unit, and the data prepared is used to convert the intensity of the back-scattered light to the ink concentration.

4. The ink jet recording apparatus according to claim 1, wherein an ink quantity per droplet of the ink is controlled in the image density correction unit.

5. The ink jet recording apparatus according to claim 4, wherein the recording head is a recording head of a thermal system in which the ink is ejected by generating heat by input of a voltage pulse to heat the ink, and wherein the ink quantity per droplet of the ink is controlled by changing a pulse width or voltage peak value of the voltage pulse in the image density correction unit.

6. The ink jet recording apparatus according to claim 1, wherein the number of ink droplets ejected is changed in the image density correction unit.

7. The ink jet recording apparatus according to claim 1, wherein the quantity of water to be injected in the ink tank or the flow path member is calculated in the image density correction unit, and the image density is corrected by injecting the calculated quantity of water.

8. The ink jet recording apparatus according to claim 7, wherein the quantity of the water per unit time is 1/10 or less of a remaining quantity of the ink.

9. The ink jet recording apparatus according to claim 1, which further comprises a circulation unit for circulating the ink along a circulation path including the ink tank, the recording head and the flow path member.

10. The ink jet recording apparatus according to claim 1, wherein an acceptable wavelength range of the applied light in the light detection unit is a range extended by ±50 nm with respect to a wavelength range of an absorption peak of the ink.

11. The ink jet recording apparatus according to claim 1, wherein a material used in the ink tank or the flow path member has such a property that a transmission rate of the light is 90% or more.

12. The ink jet recording apparatus according to claim 1, wherein a static contact angle of an inner surface to which light is applied and with which the ink comes into contact in the ink tank or the flow path member is 30 degrees or less.

13. The ink jet recording apparatus according to claim 1, wherein the light detection unit is a unit which applies light to the ink in the flow path member and detects the intensity of back-scattered light of the applied light.

* * * * *